United States Patent [19]

Sundberg

[11] 4,224,692

[45] Sep. 30, 1980

[54] FREIGHT HANDLING GLOVE

[75] Inventor: Darrell W. Sundberg, Roseville, Minn.

[73] Assignee: Sundberg Corporation, Roseville, Minn.

[21] Appl. No.: 911,531

[22] Filed: Jun. 1, 1978

[51] Int. Cl.[2] ..... A41D 19/00

[52] U.S. Cl. ..... 2/161 R

[58] Field of Search ..... 2/161 R, 159, 163, 161 A, 2/16, 20, 169, 167, 168

[56] References Cited

U.S. PATENT DOCUMENTS

| | | | |
|---|---|---|---|
| 308,863 | 12/1884 | Worley | 2/161 R X |
| 636,568 | 1/1972 | Stuner | 2/161 R |
| 1,154,122 | 9/1915 | Kouesy | 2/160 |
| 1,387,728 | 8/1921 | Kramer | 2/161 R X |
| 1,612,822 | 1/1927 | Jones | 2/161 R |
| 1,673,517 | 6/1928 | Kurz | 2/161 R |
| 1,750,181 | 3/1930 | Marinsky | 2/160 |
| 1,979,130 | 10/1934 | Wiley | 2/168 |
| 2,025,357 | 12/1935 | Pagan | 2/161 R |
| 2,060,342 | 11/1936 | Palicki | 2/161 R |
| 2,101,763 | 12/1937 | Sturm | 2/169 |
| 2,294,997 | 9/1942 | Merrion | 2/160 |
| 2,295,507 | 9/1942 | Wells et al. | 2/161 R |
| 2,357,574 | 9/1944 | Beebe | 2/161 R |
| 2,459,985 | 1/1949 | Woodbury | 2/161 R |
| 2,524,979 | 10/1950 | Kimbrell | 2/161 A |
| 2,582,240 | 1/1952 | Dumas | 2/161 A |
| 2,632,171 | 3/1953 | Kuh | 2/161 R |
| 2,705,327 | 4/1955 | Gitt | 2/161 R |
| 2,849,786 | 9/1958 | Ashley et al. | 2/161 R |
| 2,907,047 | 10/1959 | Steinberg | 2/161 A |
| 2,913,729 | 11/1959 | Wisenburg | 2/167 |
| 3,273,165 | 9/1966 | Sperandeo | 2/169 |
| 3,404,409 | 10/1968 | Tillotson et al. | 2/161 R |
| 3,588,917 | 6/1971 | Antonious | 2/161 A |
| 3,629,867 | 12/1971 | Taylor | 2/160 |
| 3,636,568 | 1/1972 | Stuner | 2/161 R |
| 3,732,575 | 5/1973 | Pakulak | 2/161 R |
| 3,739,400 | 6/1973 | Colehower | 2/161 R |
| 3,750,348 | 8/1973 | Johnson | 2/161 R |
| 3,766,564 | 10/1973 | Varley | 2/161 A |
| 3,882,548 | 5/1975 | Shinagawa et al. | 2/161 A |
| 3,918,096 | 11/1975 | Lim | 2/161 A |
| 3,952,333 | 4/1976 | Fujita | 2/161 A |
| 3,992,723 | 11/1976 | Lazanas | 2/161 R |
| 4,000,903 | 1/1977 | Sawnson | 2/161 A |
| 4,001,895 | 1/1977 | Cohen | 2/161 R |

FOREIGN PATENT DOCUMENTS

| | | | |
|---|---|---|---|
| 427167 | 4/1935 | United Kingdom | 2/168 |

*Primary Examiner*—Louis Rimrodt

*Attorney, Agent, or Firm*—Shroeder, Siegfried, Vidas, Steffey & Arrett

[57] ABSTRACT

A multilayer work glove is formed of a two part interior fabric lining directly contacting and encompassing the hand of the wearer with side seams joining the two parts in which an exterior surface layer of plastic material is bonded to the fabric lining and where a plurality of vent holes is formed through the interior fabric lining and the exterior surface layer of plastic material at web locations between the fingers and thumb of the hand outside of the work engaging surfaces.

4 Claims, 8 Drawing Figures

FREIGHT HANDLING GLOVE

This invention is directed to an article of clothing in the form of a glove and more particularly to a freight handling glove.

Typically, freight handling or industrial gloves generally take on the character such as found in U.S. Pat. Nos. 2,849,786 to Ashley, 3,404,409 to Tillotson, et al., 4,001,895 to Cohen, and 4,060,342 to Palicki. The gloves which are generally disclosed by these references are formed from what one might call a heavier material in the sense that it is a more rugged type glove initially, and then additional means are formed with or attached to the glove to enhance its sturdiness or ruggedness in handling great wear-producing articles or items. Some freight items do not take on the rather rugged character nor are packaged in containers which one might describe as being rough in nature or character. In fact, when handling smooth finished boxes such as corrugated cardboard or other similar materials, the extremely rugged glove becomes rather cumbersome and bulky and does not afford the proper grip that is needed in grasping the smooth surface containers, which incidentally may contain items which are just as heavy or bulky as other cartons or packages which are somewhat rough in nature. When dealing with the rather smooth finished cartons or containers, it is more desirable to have a glove that is close-fitting to the hand and one which is less susceptible to sliding and slipping. The sliding and slipping can occur where a glove is formed of a material, such as a rubber glove, and in which there is no means to ventilate the glove. That is, the larger, bulkier gloves which are of the rugged variety, may be loose enough to permit some movement of air within the glove and thus provide some cooling to the hand and relieve some of the perspiration which is found to form. The tighter fitting glove, which is really more desirable in handling smooth cartons and containers, is more susceptible to perspiration collecting within the glove and thus not only making it uncomfortable, but also slippery. Thus, there is a need for a glove which is form fitting, and provides a gripping surface for smooth containers and yet provides the wearer with some comfort and cooling to the hand. It is also desirable to have a glove that is usable without removal in completing shipping documents with hand held writing instruments.

It is therefore a general object to provide a freight handling glove which has a ventilating system making the glove more comfortable to wear, and reduces perspiration buildup within the glove.

It is still another object of the present invention to provide a freight handling glove which is form fitted to the hand and yet suitable for use with not only handling of freight cartons but the bills, invoices, and writing instruments.

It is another object of this invention to provide a pair of freight handling gloves which have no external seams and are generally smooth fitting and conforming with the contours of the hand.

It is still another object of this invention to provide a cross-threaded stretchable inner liner having ventilating holes formed therein and which provides insulating qualities and stretchability to the glove.

It is still another object of this invention to provide a freight handling glove which is more suitable for use with smooth sided containers and cartons.

These and other objects and advantages of the invention will more fully appear from the following description, made in connection with the accompanying drawings, wherein like reference characters refer to the same or similar parts throughout the several views, and in which.

Figure 1:
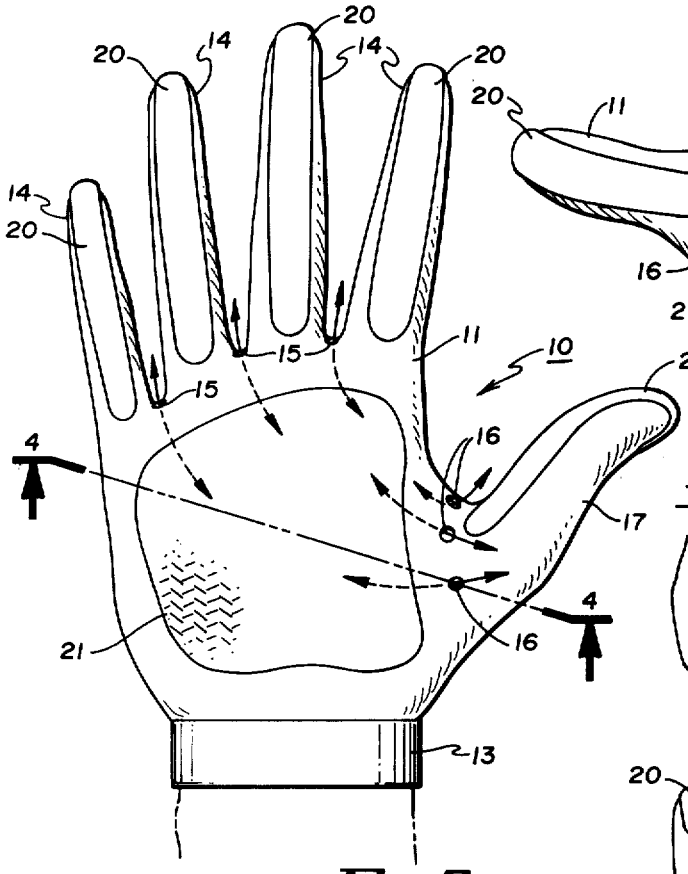
FIG. 1 is a front view of a glove disclosing my invention.
Figure 3:
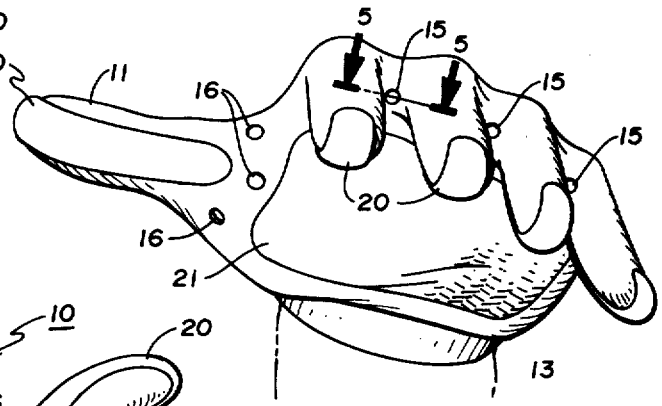
FIG. 3 is an end view as seen from the fingertips disclosing my invention.

Turning now to FIG. 1, there is shown generally a glove 10 which has an exterior surface layer 11 formed of a plastic material which may be in the nature of a polyvinyl chloride, a natural rubber or a latex material. An interior fabric lining 12 is formed on the inside of the glove and is formed in two parts, a front and back portion which is secured along its edges through the use of a seam. That is, the interior fabric lining 12 directly fits and encompasses the hand of the wearer, including the fingers, thumb and wrist to provide a form fitting and comfortable lining which also is elastic in nature. A fastener mechanism such as a Velcro ® fastener 13 is secured about the exterior surface layer 11 at the wrist area to secure the outer and inner layers of material against the wrist of the wearer. The fastener 13 anchors the glove to the wrist to aid in preventing slippage and movement of the glove with respect to the hand.

Disposed between the glove's fingers 14 is a plurality of vent holes 15 in the web area between the fingers. That is, vent holes 15 extend through the exterior surface layer 11 and the interior fabric lining 12 but out of the normal contact area of the glove with a container or carton. Another plurality of vent holes 16 is formed through the exterior surface layer 11 and interior fabric lining 12 in the web area between the thumb portion 17 of the glove and the index finger, again in a location which does not interfere with a work surface of the glove.

Additional exterior surface layers 20 are formed integrally with the exterior surface layer on the glove's fingers 14 and thumb portion 17. Those additional exterior surface layer portions extend over the ends of the glove's fingers and thumb to the back side thereof to provide additional wearing surface on the glove. Another exterior work surface layer 21 is formed in the palm of the glove to provide additional protection and gripping area. In some applications of the second layer of exterior material, a herringbone effect may be used in the surface material to assist in providing a better grip for the glove.

The glove may be formed in several ways, one method of doing so would be to dip-coat the work glove by attaching the front and back portions in a seam that forms the inner fabric lining, punching holes 15 in the inner fabric lining and then inserting a hand form into lining 12 so as to stretch out and expose the surface of the lining. The form with the interior fabric lining 12 may then be dipped in a liquid plastic material and through emersion place a substantial coating or layer over the inner fabric lining to create the exterior surface layer 11. During the process of dipping, the exterior surface layer of plastic material will form a layer 22 around the interior of the vent holes which covers all of the fabric material so that there are no exposed, ragged edges around the vent holes. Should any flashing occur across the holes 15 or 16, it may be eliminated upon removal of the glove from the hand form.

Because of the texture of the fabric interior lining, the plastic material will sufficiently engage the fibrous strands making up the fabric to ensure that there is an adequate bond between the interior fabric lining and the exterior layer. The interior fabric lining 12 is formed from a knit material to ensure that there is proper dexterity and grip in the glove for the wearer, as well as permitting the plastic material 11 and the lining 12 to expand and contract without separating from each other.

Figure 5:
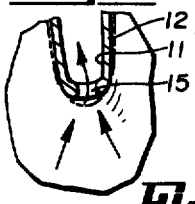
FIG. 5 is a section view of the glove taken about one of the vent holes along lines 5—5 of FIG. 3 when the hand is in a relaxed condition.
Figure 5A:
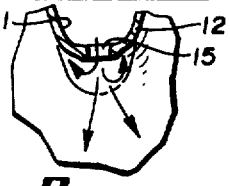
FIG. 5A is a section view of the glove taken about one of the vent holes along lines 5—5 of FIG. 3 with the hand in a constricted condition.
Figure 2:
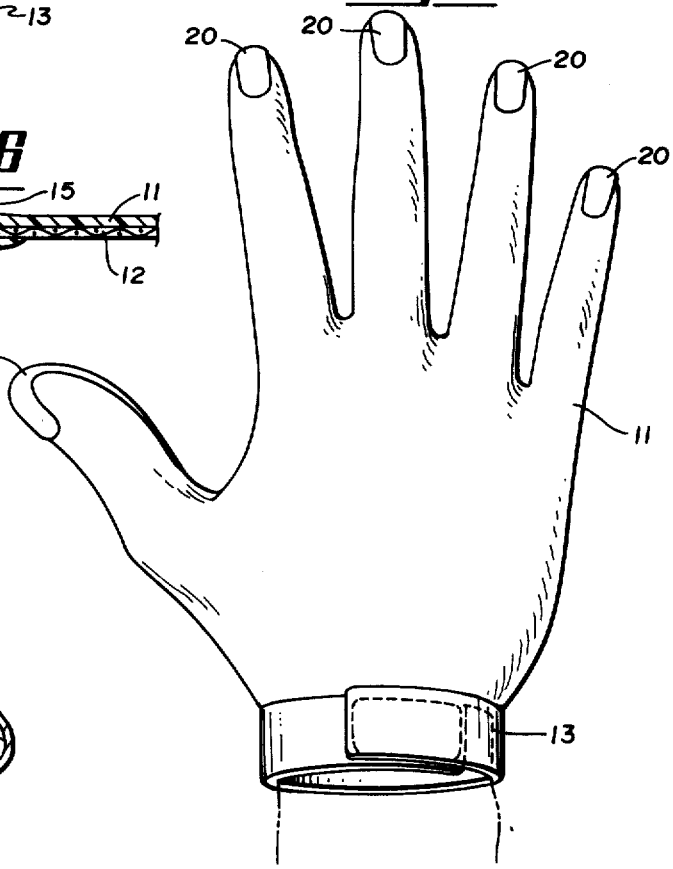
FIG. 2 is a back view of a glove disclosing my invention.
Figure 6:
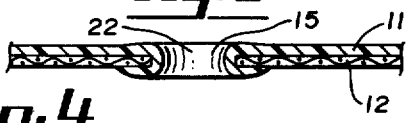
FIG. 6 is a section about one of the vent holes showing the exterior surface layer formed around the vent holes and interior fabric lining.
Figure 4:
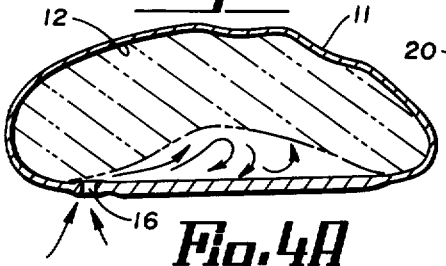
FIG. 4 is a section view of the glove taken along lines 4—4 of FIG. 1 in which the hand is relaxed.
Figure 4A:
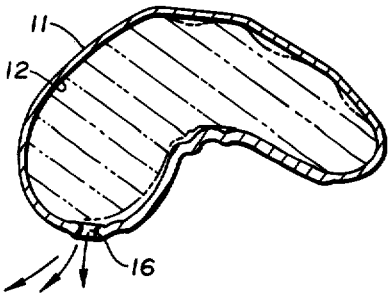
FIG. 4A is the same section view of the glove taken along lines 4—4 of FIG. 1 when the hand is constricted.

When the glove is being worn, by securing the glove tightly about the wrist through the fastener mechanism 13, as the hand is flexed or constricted, the material of the glove is compressed and expanded so that air is pumped between the vent holes 15 and 16 which provides a cooling action within the glove. This is shown in FIGS. 4 and 4A in which the hand is shown in a relaxed position and then in a constricted position in which a package might be carried and this same pumping action takes place at the vent areas between fingers 14, this action also being disclosed in FIGS. 5 and 5A. When the glove is in the relaxed condition, as shown in FIG. 5, the two layers leave very little volume between the web of the hand joining two fingers, and the glove itself. Upon grasping a carton or package, the glove is somewhat drawn away from the web area between the fingers and upon the glove again being relaxed or drawn back to its condition shown in FIG. 5, air will be forced through the vent hole 15, to provide a cooling action.

It will, of course, be understood that various changes may be made in the form, details, arrangement and proportions of the parts without departing from the scope of the invention which consists of the matter shown and described herein and set forth in the appended claims.

What is claimed is:

1. A multilayer work glove comprising:

(a) an interior fabric lining which directly contacts and encompasses the hand of a wearer including the fingers, thumb and wrist upon insertion therein, said lining having front and back portions joined by side seams;

(b) an exterior surface layer of plastic material having work-engaging surfaces bondingly secured to, and enveloping, said interior fabric lining;

(c) and a plurality of vent holes formed through said interior fabric lining and said exterior surface layer of plastic material, said exterior surface layer extending around the interior of said plurality of vent holes, said vent holes disposed at web locations between the fingers and thumb of the hand outside of said work engaging surfaces.

2. The work glove of claim 1 including a second exterior surface layer integrally formed with said exterior surface layer at said work engaging surfaces.

3. The work glove of claim 1 including a fastener mechanism constructed and arranged to encircle the wrist portion of said exterior surface layer of plastic material and secure the same against the wrist of the wearer.

4. The work glove of claim 2 wherein said second exterior surface layer integrally formed with said exterior surface layer extends over the ends of each finger and the thumb.

* * * * *